US011011305B2

(12) United States Patent
Nishio et al.

(10) Patent No.: US 11,011,305 B2
(45) Date of Patent: May 18, 2021

(54) POWDER MAGNETIC CORE, AND COIL COMPONENT

(71) Applicant: HITACHI METALS, LTD., Tokyo (JP)

(72) Inventors: Yoshimasa Nishio, Tottori (JP); Shin Noguchi, Osaka (JP); Kazunori Nishimura, Osaka (JP); Tetsuroh Katoh, Osaka (JP); Toshio Mihara, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 286 days.

(21) Appl. No.: 15/988,209

(22) Filed: May 24, 2018

(65) Prior Publication Data

US 2018/0268994 A1 Sep. 20, 2018

Related U.S. Application Data

(62) Division of application No. 14/760,964, filed as application No. PCT/JP2014/050467 on Jan. 14, 2014, now Pat. No. 10,008,324.

(30) Foreign Application Priority Data

Jan. 16, 2013 (JP) ..... 2013-005120

(51) Int. Cl.
*H01F 41/02* (2006.01)
*B22F 3/10* (2006.01)
(Continued)

(52) U.S. Cl.
CPC ..... *H01F 41/02* (2013.01); *B22F 1/02* (2013.01); *B22F 3/1039* (2013.01); *B22F 3/16* (2013.01);
(Continued)

(58) Field of Classification Search
None
See application file for complete search history.

(56) References Cited

U.S. PATENT DOCUMENTS 6,661,328 B2 12/2003 Inoue et al.
2006/0027950 A1 2/2006 Ishitani et al.
(Continued)

FOREIGN PATENT DOCUMENTS

JP 2-97646 A 4/1990
JP 2000-30925 A 1/2000
(Continued)

OTHER PUBLICATIONS

US 9,734,942 B2, 08/2017, Noguchi (withdrawn)*
(Continued)

*Primary Examiner* — Xiaowei Su
(74) *Attorney, Agent, or Firm* — Sughrue Mion, PLLC

(57) ABSTRACT

A method for manufacturing a powder magnetic core using a soft magnetic material powder, wherein the method has: a first step of mixing the soft magnetic material powder with a binder, a second step of subjecting a mixture obtained through the first step to pressure forming, and a third step of subjecting a formed body obtained through the second step to heat treatment. The soft magnetic material powder is an Fe—Cr—Al based alloy powder comprising Fe, Cr and Al. An oxide layer is formed on a surface of the soft magnetic material powder by the heat treatment. The oxide layer has a higher ratio by mass of Al to the sum of Fe, Cr and Al than an alloy phase inside the powder.

5 Claims, 5 Drawing Sheets

(51) Int. Cl.

| | |
|---|---|
| ***H01F 27/28*** | (2006.01) |
| ***B22F 3/16*** | (2006.01) |
| ***H01F 1/22*** | (2006.01) |
| ***H01F 1/147*** | (2006.01) |
| ***H01F 1/24*** | (2006.01) |
| ***H01F 1/33*** | (2006.01) |
| ***B22F 1/02*** | (2006.01) |
| ***C22C 38/00*** | (2006.01) |
| ***H01F 27/255*** | (2006.01) |
| ***C22C 38/02*** | (2006.01) |
| ***C22C 38/06*** | (2006.01) |
| ***C22C 38/18*** | (2006.01) |
| ***C22C 38/34*** | (2006.01) |
| *C22C 33/02* | (2006.01) |

(52) U.S. Cl.

CPC ..... *C22C 38/00* (2013.01); *C22C 38/002* (2013.01); *C22C 38/02* (2013.01); *C22C 38/06* (2013.01); *C22C 38/18* (2013.01); *C22C 38/34* (2013.01); *H01F 1/147* (2013.01); *H01F 1/22* (2013.01); *H01F 1/24* (2013.01); *H01F 1/33* (2013.01); *H01F 27/255* (2013.01); *H01F 27/2823* (2013.01); *H01F 41/0246* (2013.01); *B22F 2201/03* (2013.01); *B22F 2201/05* (2013.01); *B22F 2302/253* (2013.01); *B22F 2304/10* (2013.01); *C22C 33/02* (2013.01); *C22C 2202/02* (2013.01)

(56) References Cited

U.S. PATENT DOCUMENTS

| | | | |
|---|---|---|---|
| 2014/0191835 | A1 | 7/2014 | Ogawa et al. |
| 2015/0332850 | A1 | 11/2015 | Nishio et al. |

FOREIGN PATENT DOCUMENTS

| | | | |
|---|---|---|---|
| JP | 2005-220438 | A | 8/2005 |
| JP | 2006-233268 | A | 9/2006 |
| JP | 2007-162103 | A | 6/2007 |
| JP | 2008-240041 | A | 10/2008 |
| JP | 2009-088496 | A | 4/2009 |
| JP | 2009-088502 | A | 4/2009 |
| JP | 2009-158802 | A | 7/2009 |
| JP | 2009-272615 | A | 11/2009 |
| WO | 2013005454 | A1 | 1/2013 |

OTHER PUBLICATIONS

Machine translation of JP 2005-220438A. (Year: 2005).*
Machine translation of JP 2009-088502A. (Year: 2009).*
Communication dated Feb. 1, 2017 issued by the Korean Intellectual Property Office in counterpart Application No. 10-2015-7020127.
Communication dated Feb. 20, 2017 issued by the State Intellectual Property Office of the People's Republic of China in counterpart Application No. 201480004998.0.
Communication dated Jul. 6, 2016 from the State Intellectual Property Office of the People's Republic of China in counterpart application No. 201480004998.0.
Communication dated Sep. 7, 2016, from the European Patent Office in counterpart European Application No. 14740461.0.
International Preliminary Report on Patentability for Application No. PCT/JP2014/050467 dated Jul. 30, 2015, 7 pages.
International Search Report dated Apr. 15, 2014, for Application No. PCT/JP2014/050467, 2 pages.
Japanese Office Action for Application No. 2014-520083 dispatched Jun. 20, 2014, 5 pages including translation.
Korean Office Action dated Jul. 21, 2016, in corresponding Korean Patent Application No. 10-2015-7020127, 12 pages including translation.
Machine translation of JP 2009-088496, Apr. 23, 2009, 33 pages.
Machine translation of JP 2009-088502, Apr. 23, 2009, 29 pages.
Machine translation of JP 2005-220438, Aug. 18, 2005, 11 papges.

* cited by examiner

POWDER MAGNETIC CORE, AND COIL COMPONENT

CROSS REFERENCE TO RELATED APPLICATIONS

This is a divisional of application Ser. No. 14/760,964 filed Jul. 14, 2015, which is the National Stage of PCT/JP2014/050467 filed Jan. 14, 2014 (which claims benefit of Japanese Patent Application No. 2013-005120 filed Jan. 16, 2013), the disclosure of which is hereby incorporated by reference.

TECHNICAL FIELD

The present invention relates to a method for manufacturing a powder magnetic core formed by use of a soft magnetic material powder, a powder magnetic core, and a coil component formed by winding a coil around a powder magnetic core.

BACKGROUND ART

Hitherto, coil components such as an inductor, a transformer, and a choke coil, have been used in various articles such as household electric appliances, industrial equipment, and vehicles. A coil component includes a magnetic core and a coil wound around the magnetic core. In this magnetic core, ferrite, which is excellent in magnetic property, shape flexibility and costs, has widely been used.

In recent years, a decrease in the size of power source devices of electronic instruments and others has been advancing, so that intense desires have been increased for coil components which are small in size and height, and are usable against a large current. As a result, the adoption of powder magnetic cores, in each of which a metallic magnetic powder is used, and which are higher in saturation magnetic flux density than ferrite, has been advancing. Examples of the used metallic magnetic powder include Fe—Si based, and Fe—Ni based magnetic alloy powders. For coil components, the following structures are adopted: an ordinary structure in which a coil is wound around a powder magnetic core obtained by pressure forming; and additionally a structure obtained by pressure-forming a coil and a magnetic powder integrally to satisfy the request of decreasing the coil components in size and height (coil-molded structure).

A powder magnetic core obtained by compacting a magnetic alloy powder of an Fe—Si based, Fe—Ni based, or some other based type is high in saturation magnetic flux density; however, the core is low in electrical resistivity since the powder is an alloy powder. For this reason, a method is used for heightening the insulating property between particles of magnetic alloy powder, for example, a method of forming an insulating coat onto the surface of the alloy powder, and then forming the powder. Patent Document 1 discloses an example using an Fe—Cr—Al based magnetic powder as a magnetic powder enabling a self-production of a high-electrical-resistance material, which is to be an insulating coat. In Patent Document 1, the magnetic powder is subjected to oxidizing treatment to produce an oxidized film having a high electrical resistance onto the surface of the magnetic powder. This magnetic powder is solidified and formed by spark plasma sintering to yield a powder magnetic core.

PRIOR ART DOCUMENT

Patent Document

Patent Document 1: JP-A-2005-220438

SUMMARY OF THE INVENTION

Problems to be Solved by the Invention

In the case of a powder magnetic core adopted in the coil-molded structure, even when a magnetic alloy powder of the core is heightened in insulating property as described above, the application of a high pressure onto the coil, in the forming of the powder, easily causes a short circuit between conductive wires of the coil. In the meantime, in the case of using, for a coil component, a structure in which a coil is wound around a small-sized powder magnetic core obtained by pressure forming, the powder magnetic core is insufficient in strength so that the powder magnetic core is easily broken when the coil is wound. For increasing the strength of the powder magnetic core, a large pressure is required. However, because of the generation of the high pressure, problems are caused in facilities for the production, for example, the apparatus (concerned) is made large in size, and the mold is easily broken. Accordingly, the strength of practically obtained powder magnetic cores is restricted.

The structure described in Patent Document 1 does not require a high pressure as described above. However, the method described therein is a production method requiring complicated facilities and much time. Furthermore, the method requires the step of pulverizing powdery particles aggregated after the oxidizing treatment of a magnetic powder. Thus, the process becomes complicated. Additionally, the resultant magnetic powder formed body is a body sintered into a high density, so that the core loss may be unfavorably worsened, in particular, in the range of high frequency.

In light of the above-mentioned problems, the present invention has been made. An object thereof is to provide a powder magnetic core manufacturing method making it possible to yield a powder magnetic core high in strength even through a manufacturing process using a simple and easy pressure forming; a powder magnetic core that gains high strength even through a manufacturing process using a simple and easy pressure forming; and a coil component.

Means for Solving the Problems

The powder magnetic core manufacturing method of the present invention is a method for manufacturing a powder magnetic core using a soft magnetic material powder, comprising: a first step of mixing the soft magnetic material powder with a binder, a second step of subjecting a mixture obtained through the first step to pressure forming, and a third step of subjecting a formed body obtained through the second step to heat treatment; wherein the soft magnetic material powder is an Fe—Cr—Al based alloy powder comprising Fe, Cr and Al, and an oxide layer is formed on a surface of the soft magnetic material powder by the heat treatment, the oxide layer having a higher ratio by mass of Al to the sum of Fe, Cr and Al than an alloy phase inside the powder.

The use of the alloy powder comprising Fe, Cr and Al makes it possible to give a high space factor and powder magnetic core strength even by a low forming pressure. Furthermore, the heat treatment after pressure forming makes it possible to form the oxide layer, which is high in the proportion of Al on the soft magnetic material powder surface. Thus, the formation of an insulating coat also becomes easy. In conclusion, the powder magnetic core manufacturing method of the present invention makes it possible to provide a powder magnetic core excellent in strength and others through a simple and easy manufacturing process.

Further, in the method for manufacturing a powder magnetic core, it is preferable that the Cr content in the soft magnetic material powder is from 2.5 to 7.0% by mass, and the Al content therein is from 3.0 to 7.0% by mass.

Further, in the method for manufacturing a powder magnetic core, it is preferable that the space factor of the soft magnetic material powder in the powder magnetic core subjected to the heat treatment ranges from 80 to 90%.

Further, in the method for manufacturing a powder magnetic core, it is preferable that the soft magnetic material powder to be supplied to the first step has a median diameter d50 of 30 μm or less.

Further, in the method for manufacturing a powder magnetic core, it is preferable that the forming pressure at the time of the pressure forming is 1.0 GPa or less, and further the space factor of the soft magnetic material powder in the powder magnetic core subjected to the heat treatment is 83% or more.

The powder magnetic core of the present invention is a powder magnetic core, comprising a soft magnetic material powder, wherein the soft magnetic material powder is an Fe—Cr—Al based alloy powder comprising Fe, Cr and Al, a space factor of the soft magnetic material powder is 80 to 90%, and particles of the soft magnetic material powder are bonded to each other through an oxide layer having a higher ratio by mass of Al to the sum of Fe, Cr and Al than an alloy phase inside the powder.

Further, in the powder magnetic core, it is preferable that the Cr content in the soft magnetic material powder is from 2.5 to 7.0% by mass, and the Al content therein is from 3.0 to 7.0% by mass.

Further, in the powder magnetic core, it is preferable that the average of the respective maximum particle diameters of the particles of the soft magnetic material powder in an image obtained by observing a cross section of the powder magnetic core is 15 μm or less.

The coil component of the present invention is a coil component, comprising the powder magnetic core, and a coil wound around the powder magnetic core.

Effect of the Invention

The present invention makes it possible to provide a powder magnetic core manufacturing method making it possible to yield a powder magnetic core high in strength even through a manufacturing process using a simple and easy pressure forming; a powder magnetic core that gains high strength even through a manufacturing process using a simple and easy pressure forming; and a coil component.

MODE FOR CARRYING OUT THE INVENTION

Hereinafter, a description will be specifically made about respective embodiments of a method for manufacturing a powder magnetic core, a powder magnetic core, and a coil component that are each according to the present invention. However, the invention is not limited to these embodiments.

Figure 1:
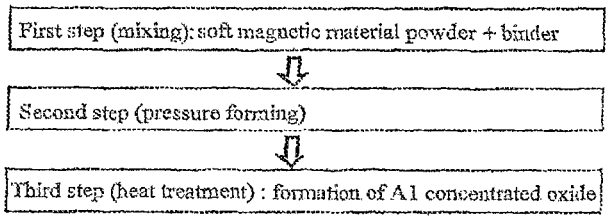
FIG. 1 is a flowchart of steps that is for describing an embodiment of a method according to the present invention for manufacturing a powder magnetic core.

FIG. 1 is a flowchart of steps that is for describing an embodiment, which is the method, for manufacturing a powder magnetic core, according to the present invention. This manufacturing method is a method of using a soft magnetic material powder to manufacture a powder magnetic core, and has a first step of mixing the soft magnetic material powder with a binder, a second step of subjecting the mixture obtained through the first step to pressure forming, and a third step of subjecting the formed body obtained through the second step to heat treatment. The used soft magnetic material powder is an Fe—Cr—Al based alloy powder containing Fe, Cr and Al. By the heat treatment in the third step, the following layer is formed on a surface of the soft magnetic material powder: an oxide layer having a higher ratio by mass of Al to the sum of Fe, Cr and Al than an alloy phase inside the powder.

An Fe—Cr—Al based alloy powder containing Cr and Al is better in corrosion resistance than an Fe—Si based alloy powder. Further, an Fe—Cr—Al based alloy powder is larger in plastic deformability than an Fe—Si based alloy powder and an Fe—Si—Cr based alloy powder. Accordingly, the Fe—Cr—Al based alloy powder can give a powder magnetic core having a high space factor and strength even by a low forming pressure. It is therefore possible to avoid an increase in the size of the forming machine, and the complication thereof. Moreover, the alloy powder can be formed by a low pressure so that the mold is restrained from being broken, and the resultant powder magnetic cores can be improved in productivity.

Furthermore, as will be detailed later, the use of the Fe—Cr—Al based alloy powder as the soft magnetic material powder makes it possible to form an insulating oxide on a surface of the soft magnetic material powder through the heat treatment after pressure forming the powder. Consequently, a step can be omitted in which an insulating oxide is formed before pressure forming, and further the manner of forming the insulating coat also becomes simple and easy. Also from these viewpoints, the productivity is improved.

A description is initially made about the soft magnetic material powder to be supplied to the first step. The composition of the Fe—Cr—Al based alloy powder containing Fe, Cr and Al as three main elements, each of which is high in content by percentage, is not particularly limited as far as the composition can constitute a powder magnetic core. Cr and Al are elements for heightening the core in corrosion resistance and others. From this viewpoint, the Cr content in the soft magnetic material powder is preferably 1.0% or more by mass, more preferably 2.5% or more by mass. However, if the Cr content is too large, the core is lowered in saturation magnetic flux density. Thus, the Cr content is preferably 9.0% or less by mass, more preferably 7.0% or less by mass, even more preferably 4.5% or less by mass. As described above, Al is an element for heightening the corrosion resistance and contributes, particularly, to the formation of the oxide on a surface. From this viewpoint, the Al content in the soft magnetic material powder is preferably 2.0% or more by mass, more preferably 3.0% or more by mass, even more preferably 5.0% or more by mass. However, if the Al content is too large, the saturation magnetic flux density is lowered. Thus, the Al content is preferably 10.0% or less by mass, more preferably 8.0% or less by mass, even more preferably 7.0% or less by mass, in particular preferably 6.0% or less by mass.

From the above-mentioned viewpoints of the corrosion resistance and the others, the total content of Cr and Al is preferably 6.0% or more by mass, more preferably 9.0% or more by mass. In order to restrain the rate of a change in the core loss relative to the heat treatment temperature, and ensure a wide controllable width of the heat treatment temperature, the total content of Cr and Al is more preferably 11% or more by mass. It is more preferred to use an Fe—Cr—Al based alloy powder in which Al is larger in content than Cr since Al is made remarkably larger in concentration than Cr in the oxide layer on a surface.

The balance other than the elements Cr and Al is mainly made of Fe. The Fe—Cr—Al based alloy powder may contain other elements as far as the powder exhibits the formability and the other advantages that the powder has. However, any nonmagnetic element makes the core low in saturation magnetic flux density and others. Thus, the content of the other elements is preferably 1.0% or less by mass. Si, which is used in Fe—Si based alloy and other alloys, is an element disadvantageous for improving the powder magnetic core in strength; thus, in the present invention, the level thereof is controlled to not more than a level of impurity contained through an ordinary process for manufacturing an Fe—Cr—Al based alloy powder. It is more preferred that the Fe—Cr—Al based alloy powder is made of Fe, Cr and Al besides inevitable impurities.

The average particle diameter of the soft magnetic material powder is not particularly limited (the diameter referred to herein is the median diameter d50 in a cumulative particle size distribution of the powder). The soft magnetic material powder may be, for example, a soft magnetic material powder having an average particle diameter of 1 to 100 μm both inclusive. By making the average particle diameter smaller, the strength, the core loss and the high-frequency property of the powder magnetic core are improved. Thus, the median diameter d50 is more preferably 30 μm or less, even more preferably 15 μm or less. When the average particle diameter is small, the powder magnetic core is lowered in magnetic permeability; thus, the median diameter d50 is more preferably 5 μm or more. More preferably, a sieve or some other is used to remove coarse particles from the soft magnetic material powder. In this case, it is preferred to use a soft magnetic material powder which has at least under-32-μm particle diameters (that is, which has passed through a sieve having a sieve opening of 32 μm).

The soft magnetic material powder is not particularly limited about the form thereof, and is preferably a granular powder, typically, an atomized powder from the viewpoint of fluidity and others. An atomizing method, such as gas atomizing or water atomizing, is suitable for producing a powder of an alloy high in malleability and ductility, and not to be easily pulverized. The atomizing method is also suitable for yielding a soft magnetic material powder in a substantially spherical form.

The following will describe the binder used in the first step. In pressure forming, the binder is to cause particles of the powder to be bonded to each other, and is to give the resultant formed body strength permitting the formed body to endure the handling thereof after the pressure forming. The kind of the binder is not particularly limited. Thus, the binder may be an organic binder that may be of various kinds, such as polyethylene, polyvinyl alcohol, or acrylic resin. The organic binder is thermally decomposed by the heat treatment after the forming. Thus, an inorganic binder, such as a silicone resin, may be together used, which is solidified to remain after heat treatment to bond the powder particles to each other. However, in the powder magnetic core manufacturing method according to the present invention, an oxide layer formed through the third step produces an effect of bonding the particles of the soft magnetic material powder to each other, and thus it is preferred to omit the use of the inorganic binder to simplify the process.

It is sufficient for the addition amount of the binder to be an amount permitting the binder to spread sufficiently between the soft magnetic material powder particles, and permitting the resultant formed body to ensure sufficient strength. If this amount is too large, the formed body is lowered in density and strength. From this viewpoint, the addition amount of the binder is preferably, for example, from 0.5 to 3.0 parts by weight for 100 parts by weight of the soft magnetic material powder.

In the first step, the method for mixing the soft magnetic material powder with the binder is not particularly limited, and may be a mixing method known in the prior art. A mixer known therein is usable. In the state that the soft magnetic material powder is mixed with the binder, the mixed powder is turned into an aggregated powder having a wide particle size distribution by the bonding effect of the binder. By making this mixed powder pass through a sieve, for example, a vibrating sieve, a granulated powder can be obtained which has a desired secondary particle diameter suitable for the pressure forming of the powder into a shape. In order to decrease friction between the powder and the mold when the pressure forming is to be performed, it is preferred to add, to the mixed powder, a lubricant agent such as stearic acid or a stearate. The addition amount of the lubricant agent is preferably from 0.1 to 2.0 parts by weight for 100 parts by weight of the soft magnetic material powder. The lubricant agent may be painted onto the mold.

The following will describe the second step of subjecting the mixture obtained through the first step to pressure forming. The mixture obtained through the first step is preferably granulated as described above, and is then supplied to the second step. A forming mold is used to subject the granulated mixture to pressure forming into a predetermined shape such as a toroidal shape or a rectangular parallelepiped shape. In the second step, the forming may be room-temperature forming, or hot forming, which is performed by heating the mixture to such a degree that the binder is not lost. The method for preparing the mixture and the method for forming the mixture are not limited to the above-mentioned methods.

When an Fe—Cr—Al based alloy powder is used as the soft magnetic material powder as described above, the resultant powder magnetic core can be heightened in space factor (relative density) and strength even by a low pressure. It is more preferred to use this effect to adjust the space factor of the soft magnetic material powder in the powder magnetic core subjected to heat treatment into the range of 80 to 90%. The reason why this range is preferred is that the elevation in the space factor makes an improvement in the magnetic property while an excessive elevation in the space factor makes a large burden on the facilities and costs. The space factor is more preferably from 82 to 90%.

It is more preferred that while the forming pressure in the pressure forming is set to 1.0 GPa or less by use of the characteristic of the Fe—Cr—Al based alloy powder, which makes an improvement in the space factor and the strength of the powder magnetic core even by a low pressure as described above, the space factor of the soft magnetic material powder in the powder magnetic core subjected to heat treatment is set to 83% or more. The forming at the low pressure makes it possible to realize the powder magnetic core having a high magnetic property and high strength, while restraining the mold from being broken or damaged. This structure is an advantageous effect resulting from the use of the Fe—Cr—Al based alloy powder.

The following will describe the third step of subjecting the formed body obtained through the second step to heat treatment. In order that the powder magnetic core can be relieved in stress strain introduced by the forming or others to gain a good magnetic property, the formed body subjected to the second step is subjected to heat treatment. By this heat treatment, an oxide layer is formed on a surface of the soft magnetic material powder to have a higher ratio by mass of Al to the sum of Fe, Cr and Al than the alloy phase inside the powder. This oxide layer is a layer grown through making the soft magnetic material powder and oxygen react with each other by the heat treatment. This layer is formed by an oxidizing reaction exceeding natural oxidation of the soft magnetic material powder. The heat treatment can be conducted in an atmosphere in which oxygen is present, such as an air, or a mixed gas of oxygen and an inert gas. The heat treatment may be conducted in an atmosphere in which water vapor is present, such as a mixed gas of water vapor and an inert gas. Of these treatments, the heat treatment in the air is simple and easy to be preferred.

By the heat treatment, the soft magnetic material powder is oxidized so that an oxide layer is formed on a surface of the powder. At this time, the concentration of Al in the Fe—Cr—Al based alloy powder is made large on a surface so that the oxide layer comes to have a higher ratio of Al to the sum of Fe, Cr and Al than the alloy phase inside the powder. Typically, in the oxide layer, in particular, Al, out of the constituent metal elements, is higher in proportion, and Fe is lower therein than in the inside alloy phase. More microscopically, in an oxide layer formed in grain boundaries between particles of the Fe—Cr—Al based alloy powder, Fe is higher in proportion at the center of the layer than in the vicinity of the alloy phase. The formation of this oxide makes an improvement of the soft magnetic material powder in insulating property and corrosion resistance. Since this oxide layer is formed after the formed body is produced, the oxide layer also contributes to the bonding between the soft magnetic material powder particles through the oxide layer. The bonding between the soft magnetic material powder particles through the oxide layer gives a high-strength powder magnetic core.

It is sufficient for the heat treatment in the third step to be conducted at any temperature at which the oxide layer is formable. This heat treatment gives a powder magnetic core excellent in strength. It is preferred for the heat treatment in the third step to be conducted at a temperature at which the soft magnetic material powder is not remarkably sintered. If the soft magnetic material powder is remarkably sintered, partial regions of the oxide layer high in Al proportion are surrounded by the alloy phase to be isolated into the form of islands. Consequently, the oxide layer is deteriorated in the function of separating the respective alloy phases of the soft magnetic material powder particles, the phases being the matrix of the powder, from each other. Thus, the powder magnetic core is also increased in core loss. A specific temperature for the heat treatment is preferably from 600 to 900° C., more preferably from 700 to 800° C., even more preferably from 750 to 800° C. Preferably, it does not occur that one or more regions of the oxide layer are substantially surrounded by the alloy phases to be isolated from each other. The phrase "it does not occur that one or more regions of the oxide layer are substantially surrounded by the alloy phases to be isolated from each other" denotes that when a polished cross section of the powder magnetic core is observed through a microscope, the number of the oxide layer region (s) surrounded by the alloy phases to be isolated from each other is 1/0.01 $mm^2$, or less. The period when the above-mentioned temperature range is kept is appropriately set in accordance with the size of the powder magnetic core, the quantity to be treated, an allowable range of a variation in properties, and others. The period is set to, for example, 0.5 to 3 hours.

A different step may be added before and/or after each of the first to third steps. For example, before the first step, a preliminary step may be added in which an insulating coat is formed onto the soft magnetic material powder by, for example, heat treatment or a sol-gel method. However, in the powder magnetic core manufacturing method of the present invention, the oxide layer can be formed on a surface of the soft magnetic material powder through the third step; it is therefore preferred to omit a preliminary step as described above to simplify the manufacturing process. The oxide layer itself does not easily deform plastically. Thus, the adoption of the above-mentioned process of forming the Al-rich oxide layer after the pressure forming makes it possible, in the pressure forming in the second step, that a high formability which the Fe—Cr—Al based alloy powder has is effectively used.

The powder magnetic core obtained as described above, itself, produces excellent advantageous effects. About, for example, a powder magnetic core, containing a soft magnetic material powder, in which the soft magnetic material powder is an alloy powder including Fe, Cr and Al, a space factor of the soft magnetic material powder is 80 to 90%, and an oxide layer having a higher ratio of Al to the sum of Fe, Cr and Al than the alloy phase inside the powder is formed on a surface of the soft magnetic material powder, the formability is excellent, so that this core is suitable for realizing a high space factor and powder magnetic core strength. Moreover, the oxide layer ensures an insulating property, and realizes a sufficient core loss for a powder magnetic core. In order to exhibit the advantageous effects of this oxide layer sufficiently, it is more preferred that the following does not occur: one or more regions of the oxide layer are substantially surrounded by the respective alloy phases to be isolated from each other.

About the powder magnetic core, in an image obtained by observing a cross section thereof, the average of the respective maximum particle diameters of the particles of the soft magnetic material powder is preferably 15 μm or less, more preferably 8 μm or less. When the soft magnetic material powder, which constitutes the powder magnetic core, is fine, the powder magnetic core is improved, particularly, in strength and high-frequency property. From this viewpoint, in the cross-section-observed image of the powder magnetic core, the proportion of the number of particles having a maximum diameter of more than 40 μm is preferably less than 1.0%. In the meantime, for restraining a decline of the core in magnetic permeability, it is preferred that the average of the maximum particle diameters is 0.5 μm or more. The average of the maximum particle diameters can be calculated by polishing the cross section of the powder magnetic core, observing the cross section through a microscope, reading out the respective maximum particle diameters of 30 or more particles present in a visual field having a certain area, and then gaining the number-average of the diameters. Although the particles of the soft magnetic material powder after the forming deform plastically, almost all of the particles are made exposed at the cross section of their portion different from their center in the cross-section-observation. For this reason, the average of the maximum particle diameters is a value smaller than the median diameter d50 estimated in the state that the particles are powder. The number proportion of particles having a maximum particle diameter of more than 40 μm is estimated in the range of a visual field of at least 0.04 $mm^2$ or more.

A coil component is provided by use of the above-mentioned powder magnetic core, and a coil wound around the powder magnetic core. The coil may be formed by winding a conductive wire around the powder magnetic core, or may be formed by winding such a wire around a bobbin. The coil component, which has the powder magnetic core and the coil, is used for, for example, a choke coil, an inductor, a reactor, or a transformer.

The powder magnetic core may be manufactured into the form of a simple powder magnetic core obtained by subjecting only a soft magnetic material powder in which a binder and others are mixed with each other as described above to pressure-forming, or may be manufactured into such a form that a coil is arranged in the core. The structure of the latter is not particularly limited. The powder magnetic core in the latter form can be manufactured into the form of, for example, a powder magnetic core having a coil-molded structure by subjecting the soft magnetic material powder and a coil integrally to pressure forming.

Examples

A powder magnetic core was manufactured as described hereinafter. As a soft magnetic material powder, an Fe—Cr—Al based soft magnetic alloy powder was used. This alloy powder was a granular atomized powder, and the composition thereof was, in terms of percentage by mass, Fe-4.0% Cr-5.0% Al. The atomized powder was passed through a sieve having a mesh of 440 (sieve opening: 32 μm) to remove coarse particles, and subsequently the resultant powder was used. The average particle diameter (median diameter d50) of the soft magnetic material powder was 18.5 μm, which was measured through a laser diffraction/scattering particle size distribution measuring apparatus (LA-920, manufactured by Horiba, Ltd.).

An emulsified acrylic resin binder in an emulsion form (POLYZOL AP-604, manufactured by Showa Highpolymer Co., Ltd.; solid content: 40%) was mixed with the alloy powder in a proportion of 2.0 parts by weight for 100 parts by weight of the powder. This mixed powder was dried at 120° C. for 10 hours, and the dried mixed powder was passed through a sieve to yield a granulated powder. To this granulated powder was added 0.4 parts by weight of zinc stearate for 100 parts by weight of the soft magnetic material powder, and then these components were mixed with each other to yield a mixture for formation into a shape.

A press machine was used to subject the resultant mixed powder to pressure forming at room temperature under a forming pressure of 0.91 GPa. The resultant formed body, which had a toroidal shape, was subjected to heat treatment at a heat treatment temperature of 800° C. in the air for 1.0 hour to yield a powder magnetic core (No. 1).

For comparison, toroidal-shape formed bodies were yielded by mixing and pressure forming under the same conditions using, as soft magnetic material powders, an Fe—Si based soft magnetic alloy powder (Fe-3.5% Si in terms of percentage by mass), and an Fe—Cr—Si based soft magnetic alloy powder (Fe-4.0Cr-3.5% Si in terms of percentage by mass), respectively. The individual formed bodies were subjected to heat treatment at 500° C. and 700° C., respectively, to yield powder magnetic cores (Nos. 2 and 3). In the case of using the Fe—Si based soft magnetic alloy powder, heat treatment at a temperature higher than 500° C. would deteriorate the resultant in core loss; thus, the heat treatment temperature of 500° C. was adopted, as described above.

The density of each of the powder magnetic cores manufactured through the above-mentioned steps was calculated out from the dimensions and the mass thereof. The density of the powder magnetic core was divided by the true density of the soft magnetic material powder to calculate out the space factor (relative density). A load was applied to the toroidal-shape powder magnetic core along the diameter direction thereof. When the core was broken, the maximum load P (N) was measured. The radial crushing strength σr (MPa) thereof was obtained in accordance with the following expression:

$$\alpha r = P(D-d)/(ld^2)$$

(D: the outside diameter (mm) of the core, d: the thickness (mm) of the core, and l: the height (mm) of the core).

Furthermore, a winding wire was wound to give 15 turns around the core at each of primary and secondary sides thereof. A B-H analyzer, SY-8232, manufactured by Iwatsu Test Instruments Corp. was used to measure the core loss Pcv thereof under conditions of a maximum magnetic flux density of 30 mT and a frequency of 300 kHz. Moreover, a conductive wire was wound to give 30 turns around each toroidal-shape powder magnetic core to measure the initial magnetic permeability μi thereof at a frequency of 100 kHz with a device, 4284A, manufactured by Hewlett-Packard Co.

TABLE 1

| No | | Heat treatment temperature (° C.) | Space factor (%) | Radial crushing strength (MPa) | Pcv (kW/$m^3$) | μi |
|---|---|---|---|---|---|---|
| 1 | Working Example (Fe—Cr—Al) | 800 | 88.2 | 238 | 488 | 49 |
| 2 | Comparative Example (Fe—Si) | 500 | 83.0 | 65 | 350 | 35 |
| 3 | Comparative Example (Fe—Cr—Si) | 700 | 82.0 | 75 | 536 | 35 |

As shown in Table 1, the powder magnetic core No. 1, which was manufactured using the Fe—Cr—Al based soft magnetic alloy powder, was largely higher in space factor and magnetic permeability than the powder magnetic core No. 2, which made use of the Fe—Si based soft magnetic alloy powder, and the powder magnetic core No. 3, which made use of the Fe—Cr—Si soft magnetic alloy powder. The powder magnetic core No. 1 had, particularly, a high radial crushing strength value of 100 MPa or more. The radial crushing strength of the powder magnetic core No. 1 showed a value two or more times a value of each of the powder magnetic cores Nos. 2 and 3. It has been understood that the structure according to this working example is very advantageous for gaining excellent radial crushing strength. In other words, according to the structure of the working example, a powder magnetic core having high strength can be provided through a simple and easy pressure forming. The corrosion resistance of each of the powder magnetic cores was estimated separately in a salt-water spraying test. As a result, the powder magnetic core No. 1 showed a better corrosion resistance than the powder magnetic core No. 3. The powder magnetic core No 2, which made use of the Fe—Si based soft magnetic alloy powder, was remarkably corroded to be insufficient in corrosion resistance.

Furthermore, the powder magnetic core No. 1 was used, and the frequency property of the initial magnetic permeability thereof was estimated. As a result, the initial magnetic permeability at 10 MHz was kept at a level of 99.0% or more of that at 1 MHz. Thus, it has been made evident that the structure according to the working example is excellent in high-frequency property also.

Figure 2:
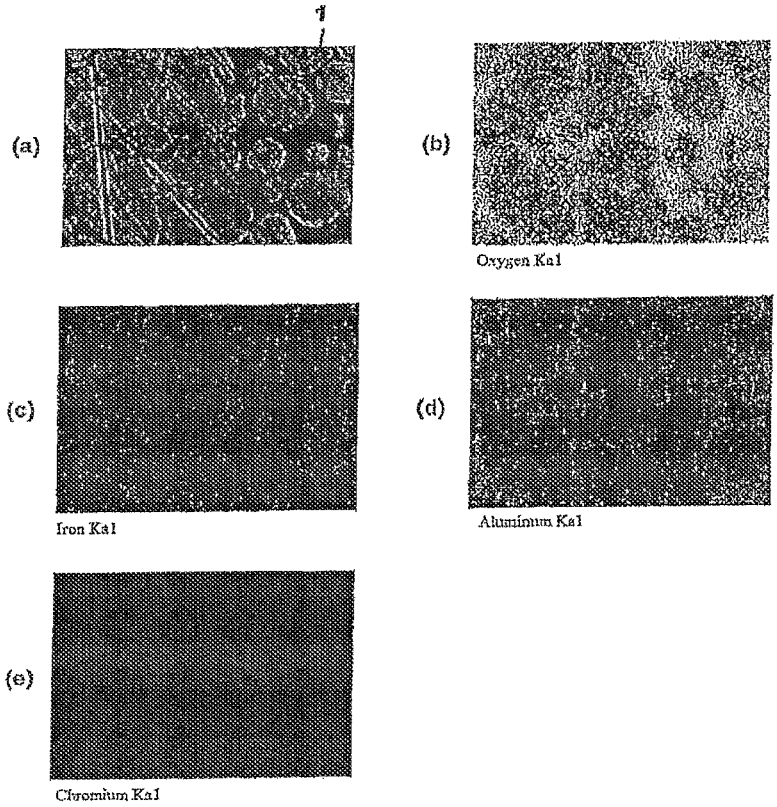
FIG. 2 are each an SEM photograph of a cross section of a powder magnetic core.
Figure 3:
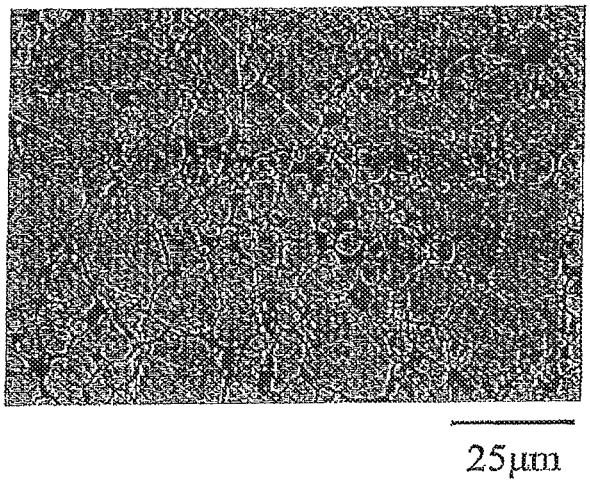
FIG. 3 is an SEM photograph of across section of a powder magnetic core.

About the powder magnetic core No. 1, a scanning electron microscope (SEM/EDX) was used to observe a cross section thereof. Simultaneously, the distribution of each of the constituent elements therein was examined. The results are shown in FIGS. 2 and 3. FIG. 2(*a*) and FIG. 3 each show an SEM image, and FIG. 2 is an image obtained by enlarging FIG. 3. It is understood that a phase having a black color tone was formed on a surface of a particle of the soft magnetic material powder 1, the particle having a bright gray color. The SEM image was used to calculate out the average of the respective maximum particle diameters of 30 or more soft magnetic material powder particles. As a result, the average was 8.8 μm. In the visual field range of 0.047 $mm^2$, a particle having a maximum particle diameter of more than 40 μm was not observed. FIGS. 2(*b*) to 2(*e*) are mappings showing the distributions of O (oxygen), Fe (iron), Al (aluminum), and Cr (chromium), respectively. As any one of the figures has a brighter color tone, the target element is larger in proportion.

From FIG. 2, it is understood that in the surface (grain boundaries) of the soft magnetic material powder, oxygen is large in proportion so that an oxide is formed, and that the particles of the soft magnetic material powder are bonded to each other through this oxide. Moreover, on the soft magnetic material powder surface, the Fe concentration is lower than inside the powder. Cr does not show a large concentration distribution. By contrast, the concentration of Al is remarkably high on the soft magnetic material powder surface. From these matters, it has been verified that on the soft magnetic material powder surface, an oxide layer is formed which has a higher ratio of Al to the sum of Fe, Cr and Al than the alloy phase inside the powder. Before the heat treatment, respective concentration distributions as shown in FIG. 2, about the constituent elements, were not observed; thus, it has been understood that the oxide layer is formed by the heat treatment. It is also understood that the respective oxide layers of the individual grain boundaries high in Al proportion are bonded to each other. In the visual field of 0.02 $mm^2$, no oxide layer regions surrounded by the alloy phase to be isolated from each other was observed. It can be considered that the structure according to this oxide layer contributes to an improvement of the powder magnetic core in properties, such as loss.

Next, in the same way as in the working example, powder magnetic cores were manufactured, using an Fe—Cr—Al based soft magnetic alloy powder identical in composition and others with the working example but different in particle diameter therefrom. The average particle diameter (median diameter d50) of the used Fe—Cr—Al based soft magnetic alloy powder was 10.2 μm. The heat treatment was conducted under the following three conditions of 700° C., 750° C., and 800° C. In the same way as in the working example, the properties were estimated. The results are shown in Table 2.

TABLE 2

| No | | Heat treatment temperature (° C.) | Space factor (%) | Radial crushing strength (MPa) | Pcv (kW/$m^3$) | μi |
|---|---|---|---|---|---|---|
| 4 | Working Example (Fe—Cr—Al) | 700 | 86.7 | 171 | 436 | 47 |
| 5 | Working Example (Fe—Cr—Al) | 750 | 87.3 | 232 | 342 | 51 |
| 6 | Working Example (Fe—Cr—Al) | 800 | 89.0 | 287 | 313 | 49 |

As shown in Table 2, in the same manner as the powder magnetic core No. 1, the powder magnetic cores Nos. 4 to 6, which were each manufactured using the Fe—Cr—Al based soft magnetic alloy powder, were largely higher in space factor, magnetic permeability and radial crushing strength than the powder magnetic core No. 2, which made use of the Fe—Si based soft magnetic alloy powder, and the powder magnetic core No. 3, which made use of the Fe—Cr—Si soft magnetic alloy powder. Furthermore, a comparison made between the powder magnetic cores Nos. 6 and 1, in which the respective heat treatment temperatures were equal to each other, demonstrates that the powder magnetic core No. 6, which made use of the Fe—Cr—Al based soft magnetic alloy powder having a median diameter d50 of 15 μm or less, was improved in the individual properties, and was largely improved, particularly, in radial crushing strength and core loss, as compared with the powder magnetic core No. 1.

From the results in Table 2, it is also understood that by raising the heat treatment temperature, the radial crushing strength is heightened and the core loss is largely improved. In particular, in the powder magnetic cores Nos. 5 and 6, for which the heat treatment was conducted at 750° C. or higher, a lower core loss was kept than in the powder magnetic core No. 2, which made use of the Fe—Si based soft magnetic alloy powder, while the cores were largely improved in radial crushing strength and magnetic permeability.

Furthermore, a silver paste was painted onto each of the powder magnetic cores Nos. 4 to 6 to form electrodes therein. A DC voltage was applied thereto to measure the electric resistance thereof, and subsequently the electrical resistivity ρ was roughly calculated from the electrode area and the distance between the electrodes. The electrical resistivities ρ of the powder magnetic cores Nos. 4 to 6 were $1\times10^3$ Ωm, $1\times10^4$ Ωm, and $1\times10^4$ Ωm, respectively, to be greatly larger than $1\times10^1$ Ωm, which was the electrical resistivity ρ of the powder magnetic core No. 2, which made use of the Fe—Si based soft magnetic alloy powder. The electrical resistivity ρ of the powder magnetic core No. 3 was $1\times10^3$ Ωm, and the respective electrical resistivities ρ of the powder magnetic cores No. 4 to 6 were electrical resistivities equivalent to or more than that of the powder magnetic core No. 3, which made use of the Fe—Cr—Si based soft magnetic alloy powder. It is considered from this matter that the structure according to the oxide layer also contributes to a rise in the electrical resistivity.

Figure 4:
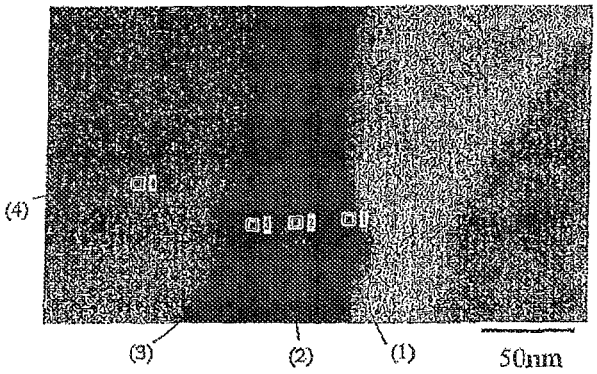
FIG. 4 is an SEM photograph of a cross section of a powder magnetic core.

The powder magnetic core No. 4 was observed through a transmission electron microscope (TEM/EDX). FIG. 4 is a TEM photograph showing a grain boundary portion between the soft magnetic material powder particles, and obtained by observing a cross section of the core. Table 3 shows analyzed values of a point of the inside of one of the soft magnetic material powder particles, and points of a grain boundary phase in FIG. 4. The balance other than the analyzed values shown in Table 3 is impurities. Analyzed point 4 is inside the particle. Analyzed point 2 is at the center of the grain boundary phase, and analyzed points 1 and 3 are near closely to the soft magnetic material powder particle in the grain boundary phase.

TABLE 3

| | Analyzed values (% by mass) | | | |
|---|---|---|---|---|
| | Cr | Al | Fe | O |
| Analyzed point 1 | 6 | 54 | 10 | 28 |
| Analyzed point 2 | 4 | 13 | 67 | 11 |
| Analyzed point 3 | 2 | 56 | 6 | 33 |
| Analyzed point 4 | 4 | 4 | 91 | 1 |

The thickness of the grain boundary phase of the powder magnetic core shown in FIG. 4 was about 40 nm. As is evident from the results in Table 3, it has been understood that as the grain boundary phase, an oxide layer is formed, and further a concentration gradient or plural phases of the constituent elements is present. Although Cr was contained also in the oxide layer, Cr therein was substantially equal in proportion to Cr in the particle of the soft magnetic material powder. The difference between the Cr concentration in the oxide layer and that in the particle was within ±3%. In the meantime, in the oxide layer, the Al content was larger than in the particle. Thus, it has been verified that Al was concentrated in the oxide layer of the grain boundary. It has been made evident that at the center of the layer, the proportion of Fe in the center of the layer was higher than the proportion of Fe near the alloy phase, and Fe was larger in proportion than Al. By contrast, in the portion near closely to the soft magnetic material powder, Al was larger in proportion than Fe. It has also been understood that Al was larger in content than Cr at both of the center of the oxide layer of the grain boundary and the portion near closely to the soft magnetic material powder.

As described above, an oxide layer has been verified which has a higher ratio of Al to the sum of Fe, Cr and Al than the alloy phase inside the soft magnetic material powder. An oxide of Al is high in insulating property, and thus it is presumed that the Al oxide is formed in grain boundaries of the soft magnetic material powder to contribute to matters that the core ensures insulating property and the core loss is decreased. Moreover, the soft magnetic material powder particles are bonded to each other through a grain boundary layer as shown in FIG. 4. This structure would contribute to an improvement of the core in strength.

Figure 5:
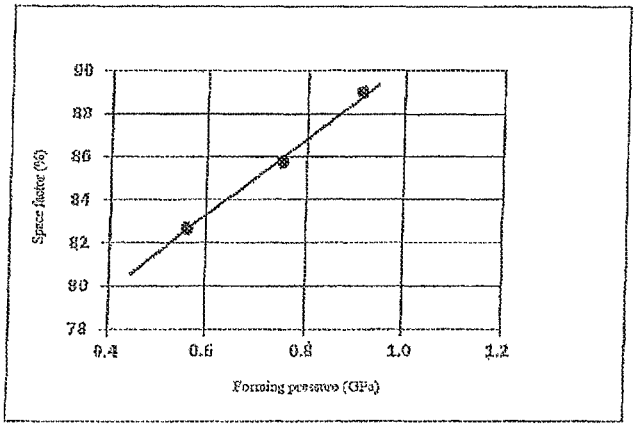
FIG. 5 is a graph showing a relationship between forming pressure and a space factor.

Next, the same mixture as used for Nos. 4 to 6 was used, and subjected to pressure forming under respective varied forming pressures. In this way, powder magnetic cores were manufactured. The heat treatment temperature was set to 800° C. The evaluation results are shown in Table 4, and the forming pressure dependency of the space factor is shown in FIG. 5.

TABLE 4

| No | Forming pressure (GPa) | Space factor (%) | Radial crushing strength (MPa) | Pcv (kW/m$^3$) | μi | ρ (Ωm) |
|---|---|---|---|---|---|---|
| 7 | 0.56 | 82.7 | 198 | 457 | 34 | $1 \times 10^5$ |

TABLE 4-continued

| No | Forming pressure (GPa) | Space factor (%) | Radial crushing strength (MPa) | Pcv (kW/m$^3$) | μi | ρ (Ωm) |
|---|---|---|---|---|---|---|
| 8 | 0.75 | 85.8 | 227 | 379 | 41 | $1 \times 10^4$ |
| 9 | 0.91 | 89.0 | 287 | 313 | 49 | $1 \times 10^4$ |

As shown in Table 4, it is understood that the adjustment of the forming pressure can yield powder magnetic cores having a space factor ranging from 80 to 90%. Moreover, a raise in the forming pressure makes an improvement in the space factor, the radial crushing strength, the core loss, and the magnetic permeability. It can also be concluded that a high radial crushing strength is ensured even when the forming pressure is conversely lowered. From the results in Table 4 and FIG. 5, it is understood that even when the forming pressure is 1.0 GPa or less, a space factor of 80% or more can be gained by setting the pressure to, for example, 0.4 GPa or more. Furthermore, when the pressure is 0.6 GPa or more and 0.7 GPa or more, a space factor of 83% or more and 85% or more are obtained, respectively. In other words, it has been made evident that even a lower forming pressure can yield a powder magnetic core having a high space factor equivalent to or larger than those of conventional Fe—Si based powder magnetic cores, so that a burden on facilities for the forming can be decreased.

Next, each atomized powder having a composition and an average particle diameter (median diameter d50) shown in Table 5 was used to manufacture a powder magnetic core in the same way as in the example No. 1 except that the forming pressure and the heat treatment temperature were changed to 0.73 GPa and 750° C., respectively. Concerning the resultant powder magnetic cores, evaluations were made about the radial crushing strength, the initial magnetic permeability μi, and the incremental permeability $\mu_\Delta$ obtained when a DC magnetic field of 10 kA/m was applied thereto. Moreover, in the same way as used for the powder magnetic core No. 1, the average of the maximum particle diameters was calculated out. The results are shown in Table 5.

TABLE 5

| No | Composition (% by mass) | d50 (μm) | Radial crushing strength (MPa) | μi | $\mu_\Delta$ | Maximum diameter average (μm) |
|---|---|---|---|---|---|---|
| 10 | Fe—4.0Cr—5.0Al | 11.5 | 280 | 42 | 21 | 7.0 |
| 11 | Fe—6.0Cr—5.0Al | 13.1 | 301 | 41 | 20 | 6.3 |
| 12 | Fe—4.0Cr—6.0Al | 12.9 | 257 | 42 | 20 | 7.8 |
| 13 | Fe—6.0Cr—6.0Al | 11.9 | 226 | 43 | 20 | 6.4 |
| 14 | Fe—8.0Cr—8.0Al | 13.5 | 209 | 56 | 21 | 6.5 |

As is clear from Table 5, the resultant powder magnetic cores were each a powder magnetic core having a high radial crushing strength of 200 MPa or more. Of the cores, the cores in which the Cr content was 6.0% or less by mass, and the Al content was 6.0% or less by mass gained a particularly high radial crushing strength. It has also been understood that even when the Cr content and the Al content were increased in the composition range shown in Table 5, the initial magnetic permeability, and the incremental permeability $\mu_\Delta$, which shows the DC bias characteristic, were each maintained at a high value level. As shown in Table 5, the average of the maximum particle diameters of each of the powder magnetic cores Nos. 10 to 14 was 8 μm or less. Furthermore, in the visual field range of 0.047 $mm^2$, the proportion of the number of particles having a maximum particle diameter over 40 μm was less than 1.0% in each of the cores. Thus, it has been verified that each of the powder magnetic cores Nos. 10 to 14 had a fine microstructure.

Next, about the composition of each of the cores Nos. 10 to 13, powder magnetic cores subjected to heat treatments conducted at 650° C. and 850° C. were manufactured in order to check a change in their properties relative to the heat treatment temperature. As the heat treatment temperature was raised, the radial crushing strength was raised. Specifically, the powder magnetic cores subjected to the heat treatment at 650° C. showed a radial crushing strength of 170 MPa or more even when the cores each had any one of the compositions. The powder magnetic cores subjected to the heat treatment at 850° C. showed a radial crushing strength of 290 MPa or more even when the cores each had any one of the compositions. According to any one of the compositions of the cores Nos. 10 to 13, the core loss showed a minimum value at 750° C. When the heat treatment temperature was to 850° C., the core loss tended to be increased. According to the composition of each of the cores Nos. 10 and 12, the powder magnetic core subjected to the heat treatment at 850° C. was made larger, by 100% or more, in core loss than the powder magnetic core subjected to the heat treatment at 750° C. According to the composition of the core No. 11 and that of the core No. 13, the increase rate of the core loss was 62% and 20%, respectively. In other words, the following has been understood: as the content of Cr and Al is made larger, the change rate of the core loss relative to the heat treatment temperature becomes smaller so that a controllable range of the heat treatment temperature has a margin.

Next, for comparison, a spark plasma sintering disclosed in Patent Document 1 was used as described below to manufacture a powder magnetic core. An atomized powder having a composition of Fe-4.0% Cr-5.0% Al in terms of mass by percentage and an average particle diameter (median diameter d50) of 9.8 μm was thermally treated at 900° C. in the air for 1 hour. The thermally treated atomized powder was solidified into a bulk form. Thus, it was necessary that before the step of spark plasma sintering, a crushing step was added. The thermally treated and crushed atomized powder was fed into a graphite mold without adding any binder to the powder, and then the mold was put into a chamber to subject the powder to spark plasma sintering at a pressure of 50 MPa and a heating temperature of 900° C. for a holding period of 5 minutes. The resultant sintered body was made mainly of oxides. Thus, a desired magnetic core could not be obtained. It is considered that the failure was based on an excessive oxidization of the atomized powder at the time of the thermal treatment of the atomized powder before the spark plasma sintering. It has been therefore verified that the manufacturing method disclosed in Patent Document 1 is complicated in producing process, and additionally the method cannot be directly applied to the case of using a fine atomized powder.

DESCRIPTION OF REFERENCE SIGN

1: Soft magnetic material powder

What is claimed is:

1. A powder magnetic core, comprising a soft magnetic material powder, wherein the soft magnetic material powder is an Fe—Cr—Al based alloy powder consisting essentially of Fe, Cr and Al, a space factor of the soft magnetic material powder is 80 to 90%, particles of the soft magnetic material powder are bonded to each other by an oxide layer having a higher ratio by mass of Al to the sum of Fe, Cr and Al than an alloy phase inside the powder, an average of respective maximum particle diameters of the particles of the soft magnetic material powder in an image obtained by observing a cross section of the powder magnetic core is 15 μm or less, and in an image obtained by observing a cross section of the powder magnetic core, the proportion of the number of particles having a maximum diameter of more than 40 μm is less than 1.0%.

2. The powder magnetic core according to claim 1, wherein the Cr content in the soft magnetic material powder is from 2.5 to 7.0% by mass, and the Al content therein is from 3.0 to 7.0% by mass.

3. The powder magnetic core according to claim 1, wherein the average of the respective maximum particle diameters of the particles of the soft magnetic material powder in an image obtained by observing a cross section of the powder magnetic core is 8 μm or less.

4. A coil component, comprising a powder magnetic core according to claim 1, and a coil wound around the powder magnetic core.

5. The powder magnetic core according to claim 1, wherein the oxide layer has a part in which Fe is larger in proportion than Al.

* * * * *